US007349842B2

(12) United States Patent
Youn

(10) Patent No.: US 7,349,842 B2
(45) Date of Patent: Mar. 25, 2008

(54) RATE-DISTORTION CONTROL SCHEME IN AUDIO ENCODING

(75) Inventor: Jeongnam Youn, San Jose, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 498 days.

(21) Appl. No.: 10/674,945

(22) Filed: Sep. 29, 2003

(65) Prior Publication Data

US 2005/0075871 A1 Apr. 7, 2005

(51) Int. Cl.
*G10L 19/02* (2006.01)

(52) U.S. Cl. ..... 704/229; 704/201

(58) Field of Classification Search ..... None
See application file for complete search history.

(56) References Cited

U.S. PATENT DOCUMENTS

| | | | |
|---|---|---|---|
| 4,964,113 | A | 10/1990 | Geyer et al. |
| 5,488,665 | A | 1/1996 | Johnston et al. |
| 5,497,435 | A | 3/1996 | Berger |
| 5,535,300 | A | 7/1996 | Hall, II et al. |
| 5,596,676 | A | 1/1997 | Swaminathan et al. |
| 5,636,324 | A | 6/1997 | Teh et al. |
| 5,657,454 | A | 8/1997 | Benbassat et al. |
| 5,703,579 | A | 12/1997 | Nonaka et al. |
| 5,717,764 | A | 2/1998 | Johnston et al. |
| 5,729,556 | A | 3/1998 | Benbassat et al. |
| 5,748,763 | A | 5/1998 | Rhoads |
| 5,758,315 | A | 5/1998 | Mori |
| 5,777,812 | A | 7/1998 | Kim |
| 5,864,802 | A | 1/1999 | Kim |
| 5,893,066 | A | 4/1999 | Hong |
| 5,946,652 | A | 8/1999 | Heddle |
| 5,956,674 | A | 9/1999 | Smyth et al. |
| 5,982,935 | A | 11/1999 | Arbel |
| 5,999,899 | A | 12/1999 | Robinson |
| 6,108,622 | A | 8/2000 | Xue |
| 6,173,024 | B1 | 1/2001 | Nanba et al. |
| 6,282,631 | B1 | 8/2001 | Arbel |
| 6,295,009 | B1 | 9/2001 | Goto |
| 6,298,087 | B1 | 10/2001 | Luna et al. |
| 6,308,150 | B1 | 10/2001 | Neo et al. |

(Continued)

OTHER PUBLICATIONS

Smithers et al., "Increased efficiency MPEG-2 ACC Encoding" AES 111th Convention, New York, NY, Sep. 21-24, 2001.*

(Continued)

*Primary Examiner*—V. Paul Harper
(74) *Attorney, Agent, or Firm*—Blakely, Sokoloff, Taylor & Zafman LLP

(57) ABSTRACT

An initial number of bits associated with an initial common scale factor is determined, an initial increment is computed using the initial number of bits and a target number of bits, and the initial scale factor is incremented by the initial increment. Further, the incremented common scale factor is adjusted based on the target number of bits, and individual scale factors are computed based on the adjusted common scale factor and allowed distortion. If a current number of bits associated with the computed individual scale factors exceeds the target number of bits, the adjusted common scale factor is modified until a resulting number of bits no longer exceeds the target number of bits.

21 Claims, 9 Drawing Sheets

U.S. PATENT DOCUMENTS

| | | | | |
|---|---|---|---|---|
| 6,330,335 | B1 | 12/2001 | Rhoads | |
| 6,344,808 | B1 | 2/2002 | Taruki et al. | |
| 6,349,284 | B1 | 2/2002 | Park et al. | |
| 6,424,939 | B1 | 7/2002 | Herre et al. | |
| 6,456,963 | B1 | 9/2002 | Araki | |
| 6,456,968 | B1 | 9/2002 | Taniguchi et al. | |
| 6,484,142 | B1 | 11/2002 | Miyasaka et al. | |
| 6,487,535 | B1 | 11/2002 | Smyth et al. | |
| 6,529,604 | B1 | 3/2003 | Park et al. | |
| 6,542,863 | B1 | 4/2003 | Surucu | |
| 6,577,252 | B2 | 6/2003 | Hotta | |
| 6,587,057 | B2 | 7/2003 | Scheuermann | |
| 6,662,154 | B2 | 12/2003 | Mittal et al. | |
| 6,704,705 | B1 | 3/2004 | Kabal et al. | |
| 6,794,996 | B2 | 9/2004 | Tsutsui et al. | |
| 6,799,164 | B1 | 9/2004 | Araki | |
| 6,950,794 | B1 * | 9/2005 | Subramaniam et al. | 704/200.1 |
| 2003/0079222 | A1 * | 4/2003 | Boykin et al. | 725/31 |
| 2003/0083867 | A1 * | 5/2003 | Lopez-Estrada et al. | 704/219 |
| 2003/0088400 | A1 * | 5/2003 | Nishio et al. | 704/201 |
| 2003/0115052 | A1 | 6/2003 | Chen et al. | |
| 2003/0142746 | A1 | 7/2003 | Tanaka et al. | |
| 2003/0187634 | A1 | 10/2003 | Li | |
| 2003/0215013 | A1 | 11/2003 | Budnikov | |
| 2004/0088160 | A1 | 5/2004 | Manu | |
| 2004/0162720 | A1 * | 8/2004 | Jang et al. | 704/200.1 |

OTHER PUBLICATIONS

Poondikulam L.S., et al., "Efficient Implementation of Transform Based Audio Coders Using SIMD Paradigm and Multifunction Computations," Sasken Communication Technologies, Limited, Bangalore, India, Available: http://www.sasken.com/others/wpapers/paper_0007.pdf, 5 pages.

Wang, Y., et al., "An Excitation Level Based Psychoacoustic Model For Audio Compression," Nokia Research Center, Speech and Audio Systems Lab, Tampere Finland, Downloaded May 29, 2003, Available: http://www.kom.e-technik.tu-darmstadt.de/acmmm99/ep/wang.

Daniel Domazet, Mario Kovac, "Advanced Software Implementation Of MPEG-4 AAC Audio Encoder", EC-VIP-MC, 2003, 4th EURASIP Conference Focused On Video/Imaging Processing and Multimedia Communications, Jul. 2-5, 2003, Zagreb, Croatia.

K. Brandenburg and H. Popp, "An Introduction To MPEG Layer-3", EBU Technical Review, Jun. 2000, pp. 1-15, Popp and Brandenburg, (Fraunhofer IIS).

* cited by examiner

RATE-DISTORTION CONTROL SCHEME IN AUDIO ENCODING

FIELD OF THE INVENTION

The invention relates to audio encoding in general. More particularly, the invention relates to a rate-distortion control scheme for encoding of digital data.

COPYRIGHT NOTICE/PERMISSION

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright © 2001, Sony Electronics, Inc., All Rights Reserved.

BACKGROUND OF THE INVENTION

The standardized body, Motion Picture Experts Group (MPEG), discloses conventional data compression methods in their standards such as, for example, the MPEG-2 advanced audio coding (AAC) standard (see ISO/IEC 13818-7) and the MPEG-4 AAC standard (see ISO/IEC 14496-3). These standards are collectively referred to herein as the MPEG standard.

An audio encoder defined by the MPEG standard receives an input pulse code modulation (PCM) signal, converts it through a modified discrete cosine transform (MDCT) operation into frequency spectral data, and determines optimal scale factors for quanitizing the frequency spectral data using a rate-distortion control mechanism. The audio encoder further quantizes the frequency spectral data using the optimal scale factors, groups the resulting quantized spectral coefficients into scalefactor bands, and then subjects the grouped quantized coefficients to Huffman encoding.

According to the MPEG standard, the rate-distortion control mechanism operates iteratively to select scale factors that can produce spectral data satisfying two major requirements. Firstly, the quantization noise (audio quality) may not exceed allowed distortion that indicates the maximum amount of noise that can be injected into the spectral data without becoming audible. The allowed distortion is typically determined based on psychoacoustic modeling of human hearing. Secondly, the amount of used bits resulting from the Huffman encoding may not exceed an allowable amount of bits calculated from the bit rate specified upon encoding.

The rate-distortion control mechanism typically defines individual scale factors and a common scale factor. Individual scale factors vary for different scalefactor bands within the frame and a common scale factor is not changed within the frame. According to the MPEG standard, the rate-distortion control process iteratively increments an initial (the smallest possible) common scale factor to minimize the difference between the amount of used bits resulting from the Huffman encoding and the allowable amount of bits calculated from the bit rate specified upon encoding. Then, the rate-distortion control process checks the distortion of each individual scalefactor band and, if the allowed distortion is exceeded, amplifies the scalefactor bands, and calls the common scale factor loop again. This rate-distortion control process is reiterated until the noise of the quantized frequency spectrum becomes lower than the allowed distortion and the amount of bits required for quantization becomes lower than the allowable amount of bits.

The above-described conventional rate-distortion control process takes a large amount of computation because it has to process a wide range of possible scale factors. In addition, it lacks the ability to choose optimal scale factors when a low bit-rate (below 64 kbits/sec) is required.

SUMMARY OF THE INVENTION

An initial number of bits associated with an initial common scale factor is determined, an initial increment is computed using the initial number of bits and a target number of bits, and the initial scale factor is incremented by the initial increment. Further, the incremented common scale factor is adjusted based on the target number of bits, and individual scale factors are computed based on the adjusted common scale factor and allowed distortion. If a current number of bits associated with the computed individual scale factors exceeds the target number of bits, the adjusted common scale factor is modified until a resulting number of bits no longer exceeds the target number of bits.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE INVENTION

In the following detailed description of embodiments of the invention, reference is made to the accompanying drawings in which like references indicate similar elements, and in which is shown, by way of illustration, specific embodiments in which the invention may be practiced. These embodiments are described in sufficient detail to enable those skilled in the art to practice the invention, and it is to be understood that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 1:
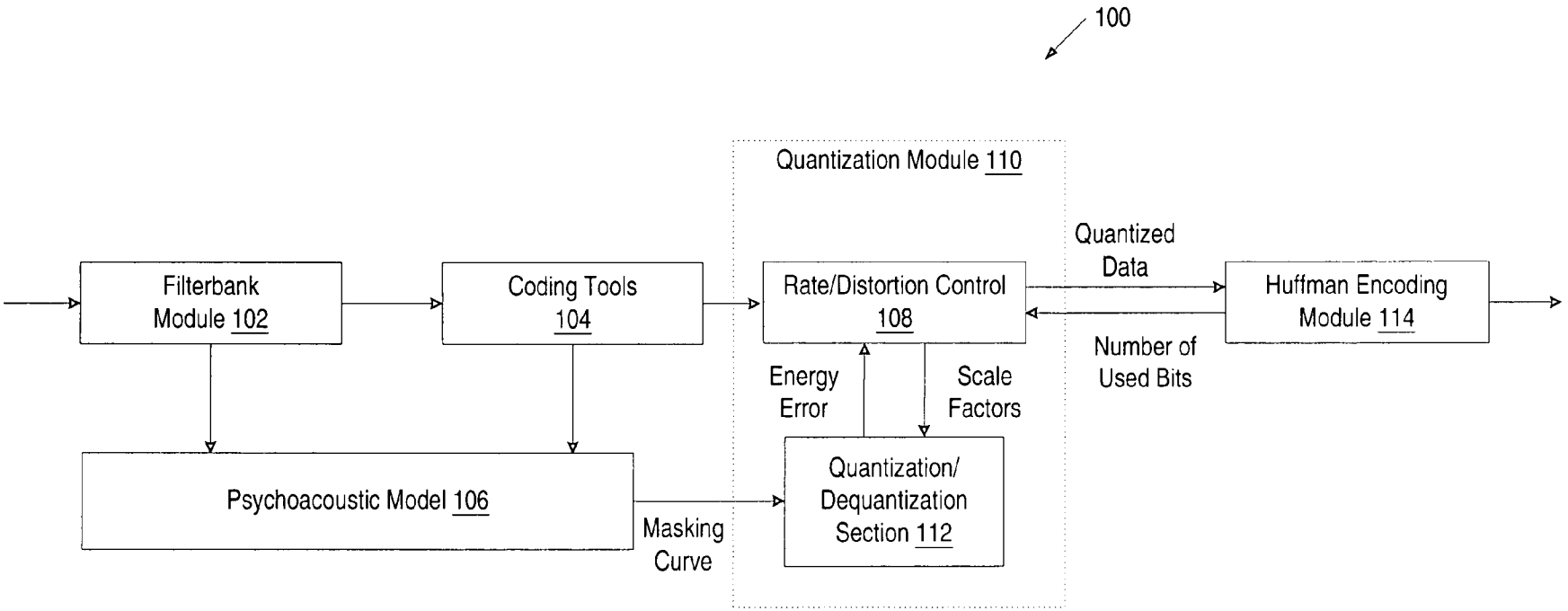
FIG. 1 is a block diagram of one embodiment of an encoding system.

Beginning with an overview of the operation of the invention, FIG. 1 illustrates one embodiment of an encoding system 100. The encoding system 100 is in compliance with MPEG audio coding standards (e.g., the MPEG-2 AAC standard, the MPEG-4 AAC standard, etc.) that are collectively referred to herein as the MPEG standard. The encoding system 100 includes a filterbank module 102, coding tools 104, a psychoacoustic modeler 106, a quantization module 110, and a Huffman encoding module 114.

The filterbank module 102 receives a pulse code modulation (PCM) signal, modulates it using a window function, and then performs a modified discrete cosine transform operation (MDCT). The window function modulates the signal using two types of operation, one being a long window type in which a signal to be analyzed is expanded in time for improved frequency resolution, the other being a short window type in which a signal to be analyzed is shortened in time for improved time resolution. The long window type is used in the case where there exists only a stationary signal, and the short window type is used when there is a rapid signal change. By using these two types of operation according to the characteristics of a signal to be analyzed, it is possible to prevent the generation of unpleasant noise called a pre-echo, which would otherwise result from an insufficient time resolution. The MDCT operation is performed to convert the time-domain signal into a number of samples of frequency spectral data.

The coding tools 104 include a set of optional tools for spectral processing. For example, the coding tools may include a temporal noise shaping (TNS) tool and a prediction tool. The TNS tool may be used to control the temporal shape of the noise within each window of the transform and to solve the pre-echo problem. The prediction tool may be used to remove the correlation between the samples.

The psychoacoustic modeler 106 analyzes the samples to determine an auditory masking curve. The auditory masking curve indicates the maximum amount of noise that can be injected into each respective sample without becoming audible. What is audible in this respect is based on psychoacoustic models of human hearing. The auditory masking curve serves as an estimate of a desired noise spectrum.

The quantization module 110 is responsible for selecting optimal scale factors for the frequency spectral data. As will be discussed in more detail below, the scale factor selection process is based on allowed distortion computed from the masking curve and the allowable number of bits (referred to as a target number of bits) calculated from the bit rate specified upon encoding. Once the optimal scale factors are selected, the quantization module 110 uses them to quantize the frequency spectral data. The resulting quantized spectral coefficients are grouped into scalefactor bands (SFBs). Each SFB includes coefficients that resulted from the use of the same scale factor.

The Huffman encoding module 114 is responsible for selecting an optimal Huffman codebook for each group of quantized spectral coefficients and performing the Huffman-encoding operation using the optimal Huffman codebook. The resulting variable length code (VLC), data identifying the codebook used in the encoding, the scale factors selected by the quantization module 110, and some other information are subsequently assembled into a bit stream.

In one embodiment, the quantization module 110 includes a rate-distortion control section 108 and a quantization/dequantization section 112. The rate-distortion control section 108 performs an iterative scale factor selection process for each frame of spectral data. In this process, the rate-distortion control section 108 finds an optimal common scale factor for the entire frame and optimal individual scale factors for different scalefactor bands within the frame.

In one embodiment, the rate-distortion control section 108 begins with setting an initial common scale factor to the value of a common scale factor of a previous frame or another channel. The quantization/dequantization section 112 quantizes the spectral data within the frame using the initial common scale factor and passes the quantized spectral data to the Huffman encoding module 114 that subjects the quantized spectral data to Huffman encoding to determine the number of bits used by the resulting VLC. Based on this number of used bits and the target number of bits calculated from the bit rate specified upon encoding, the rate-distortion control section 108 determines a first increment for the initial common scale factor. When the first increment is added to the initial common scale factor, the incremented common scale factor produces the number of bits that is relatively close to the target number of bits. Then, the rate-distortion control section 108 further adjusts the incremented common scale factor to achieve a more precise proximity of the resulting number of used bits to the target number of bits.

Further, the rate-distortion control section 108 computes individual scale factors for scalefactor bands within the frame. As will be discussed in more detail below, the individual scale factors are computed based on the adjusted common scale factor and allowed distortion. In one embodiment, the computation of each individual scale factor involves iterative modification of each individual scale factor until an energy error associated with a specific individual scale factor is below the allowed distortion. In one embodiment, the energy error is calculated by the quantization/dequantization section 112 by quantizing frequency spectral data of a scalefactor band using a given scale factor, then dequantizing this quantized data with the given scale factor, and then computing the difference between the original (pre-quantized) frequency spectral data and the dequantized spectral data.

Once individual scale factors are computed, the rate-distortion control section 108 determines whether a number of bits produced by use of the individual scale factors and the adjusted common scale factor exceeds the target number of bits. If so, the rate-distortion control section 108 further modifies the adjusted common scale factor until a resulting number of used bits no longer exceeds the target number of bits. Because the computed individual scale factors produce the desired profile of the quantization noise shape, they do not need to be recomputed when the adjusted common scale factor is modified.

FIGS. 2-6 are flow diagrams of a scale factor selection process that may be performed by a quantization module 110 of FIG. 1, according to various embodiments of the present invention. The process may be performed by processing logic that may comprise hardware (e.g., circuitry, dedicated logic, etc.), software (such as run on a general purpose computer system or a dedicated machine), or a combination of both. For software-implemented processes, the description of a flow diagram enables one skilled in the art to develop such programs including instructions to carry out the processes on suitably configured computers (the processor of the computer executing the instructions from computer-readable media, including memory). The computer-executable instructions may be written in a computer programming language or may be embodied in firmware logic. If written in a programming language conforming to a recognized standard, such instructions can be executed on a variety of hardware platforms and for interface to a variety of operating systems. In addition, the embodiments of the present invention are not described with reference to any particular programming language. It will be appreciated that a variety of programming languages may be used to implement the teachings described herein. Furthermore, it is common in the art to speak of software, in one form or another (e.g., program, procedure, process, application, module, logic . . . ), as taking an action or causing a result. Such expressions are merely a shorthand way of saying that execution of the software by a computer causes the processor of the computer to perform an action or produce a result. It will be appreciated that more or fewer operations may be incorporated into the processes illustrated in FIGS. 2-6 without departing from the scope of the invention and that no particular order is implied by the arrangement of blocks shown and described herein.

Figure 2:
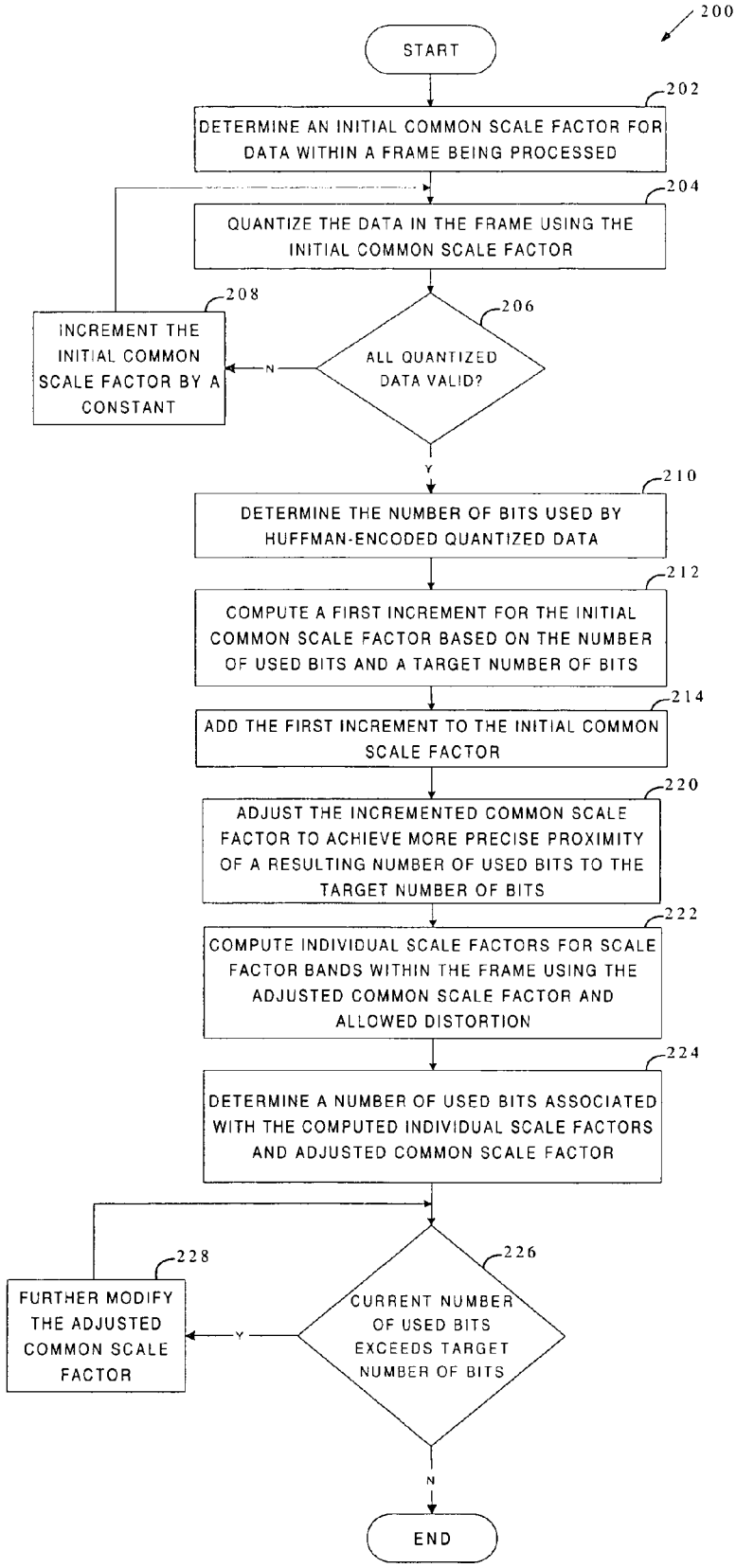
FIG. 2 is a flow diagram of one embodiment of a process for selecting optimal scale factors for data within a frame.

FIG. 2 is a flow diagram of one embodiment of a process 200 for selecting optimal scale factors for data within a frame.

Referring to FIG. 2, processing logic begins with determining an initial common scale factor for data within a frame being processed (processing block 202). The frame data may include frequency spectral coefficients such as MDCT frequency spectral coefficients. In one embodiment, processing logic determines the initial common scale factor for the frame by ensuring that a spectral coefficient with the largest absolute value within the frame is not equal to zero, and then setting the initial common scale factor to a common scale factor of a previous frame or another channel. For example, the initial common scale factor in channel 0 may be set to a common scale factor of the previous frame, and the initial common scale factor in channel 1 may be set to a common scale factor of channel 0. If the spectral coefficient with the largest value in the frame is equal to zero, processing logic sets the initial common scale factor to a predefined number (e.g., 30) that may be determined experimentally.

Next, processing logic quantizes the data in the frame using the initial common scale factor (processing block 204) and tests the validity of the resulting quantized data (decision box 206). In one embodiment, a quantized spectral coefficient is valid if its absolute value does not exceed a threshold number (e.g., 8191 according to the MPEG standard). If the resulting quantized data is not valid, processing logic increments the initial common scale factor by a constant (e.g., 5) that may be determined experimentally (processing block 208).

If the resulting quantized data is valid, processing logic determines the number of bits that are to be used by Huffman-encoded quantized data (processing block 210), computes a first increment for the initial common scale factor based on the number of used bits and a target number of bits (processing block 212), and adds the first increment to the to the initial common scale factor (processing block 214). As discussed above, the target number of bits may be calculated from the bit rate specified upon encoding.

In one embodiment, the first increment is calculated using the following expression:

$$\text{initial_increment}=10*(\text{initial_bits}-\text{target_bits})/\text{target_bits},$$

wherein initial_increment is the first increment, initial_bits is the number of used bits, and target_bits is the target number of bits. The above expression was developed (e.g., during a series of experiments) to provide a dynamic increment scheme directed to achieving a fast convergence of the number of used bits to the target number of bits. That is, the incremented common scale factor produces the number of used bits that is likely to be relatively close to the target number of bits. However, the produced number of used bits may still be higher or lower than the target number of bits.

Next, processing logic further adjusts the incremented common scale factor to achieve a more precise proximity of the resulting number of used bits to the target number of bits (processing block 220). One embodiment of the adjustment process will be discussed in more detail below in conjunction with FIG. 3.

At processing block 222, processing logic computes individual scale factors for scalefactor bands within the frame using the adjusted common scale factor and allowed distortion. In one embodiment, the allowed distortion is calculated based on a masking curve obtained from a psychoacoustic modeler 106 of FIG. 1. One embodiment of a process for computing individual scale factors is discussed in more detail below in conjunction with FIG. 5.

Further, processing logic determines a number of bits produced by use of the computed individual scale factors and the adjusted common scale factor (processing block 224) and determines whether this number of used bits exceeds the target number of bits (decision box 226). If so, processing logic further modifies the adjusted common scale factor until the resulting number of used bits no longer exceeds the target number of bits (processing block 226). One embodiment of a process for determining a final common scale factor will be discussed in more detail below in conjunction with FIG. 6. As discussed above, the individual scale factors do not need to be recomputed when the common scale factor is modified.

Figure 3:
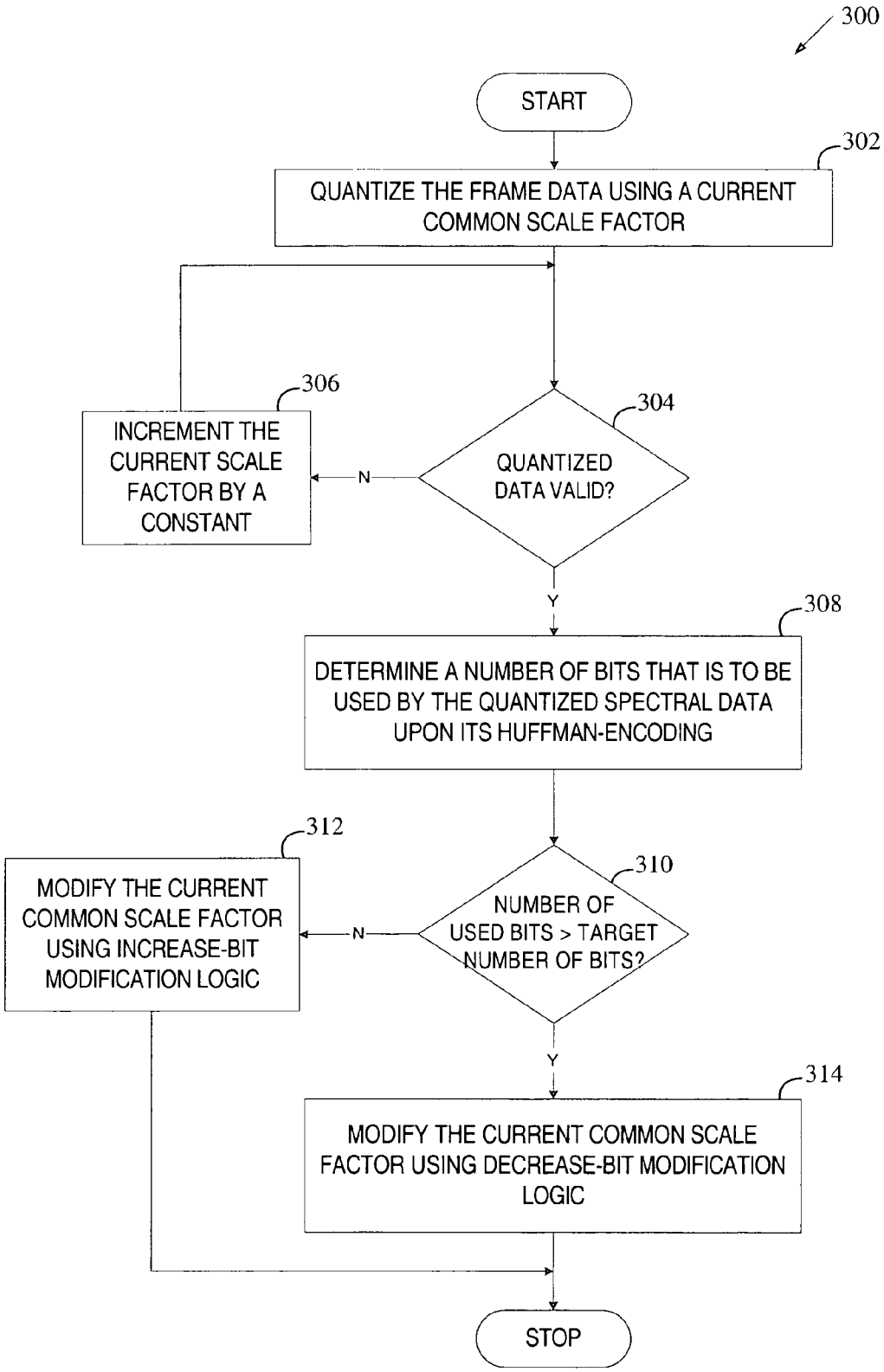
FIG. 3 is a flow diagram of one embodiment of a process for adjusting a common scale factor.

FIG. 3 is a flow diagram of one embodiment of a process 300 for adjusting a common scale factor.

Referring to FIG. 3, processing logic begins with quantizing the frame data using a current common scale factor (processing block 302). In one embodiment, the current common scale factor is the incremented scale factor calculated at processing block 214 of FIG. 2.

Next, processing logic checks whether the quantized data is valid (decision box 304). If not, processing logic increments the current scale factor by a constant (e.g., 5) (processing block 306). If so, processing logic determines a number of bits be used by the quantized spectral data upon Huffman-encoding (processing block 308).

Further, processing logic determines whether the number of used bits exceeds the target number of bits (decision box 310). If not, then more bits can be added to the data transmitted after Huffman encoding. Hence, processing logic modifies the current common scale factor using increase-bit modification logic (processing block 312). If the determination made at decision box 310 is positive, then processing logic modifies the current common scale factor using decrease-bit modification logic (processing block 314).

Figure 4A:
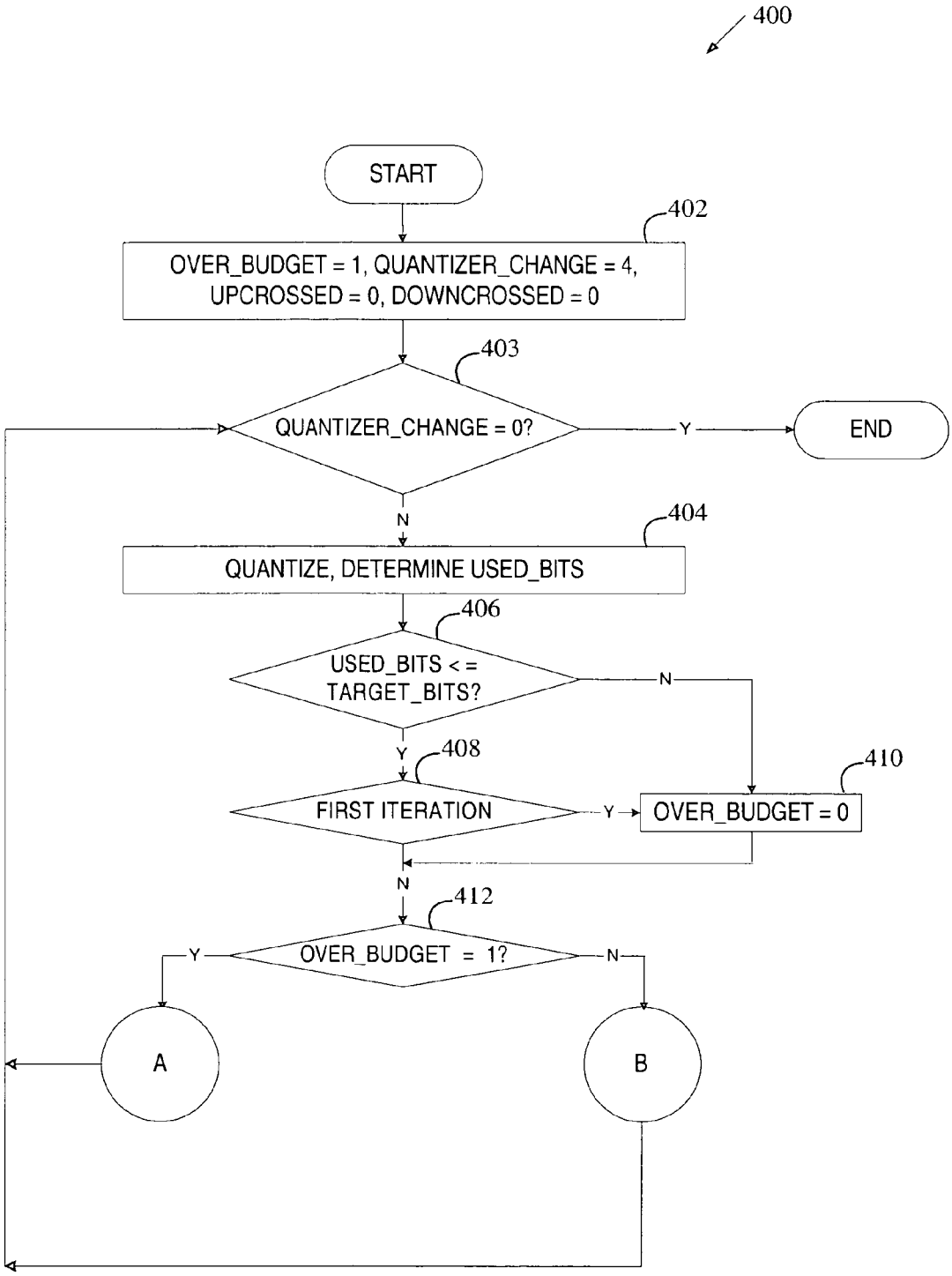
FIGS. 4A-4C are flow diagrams of one embodiment of a process for using increase-bit/decrease-bit modification logic when modifying a common scale factor.
Figure 4B:
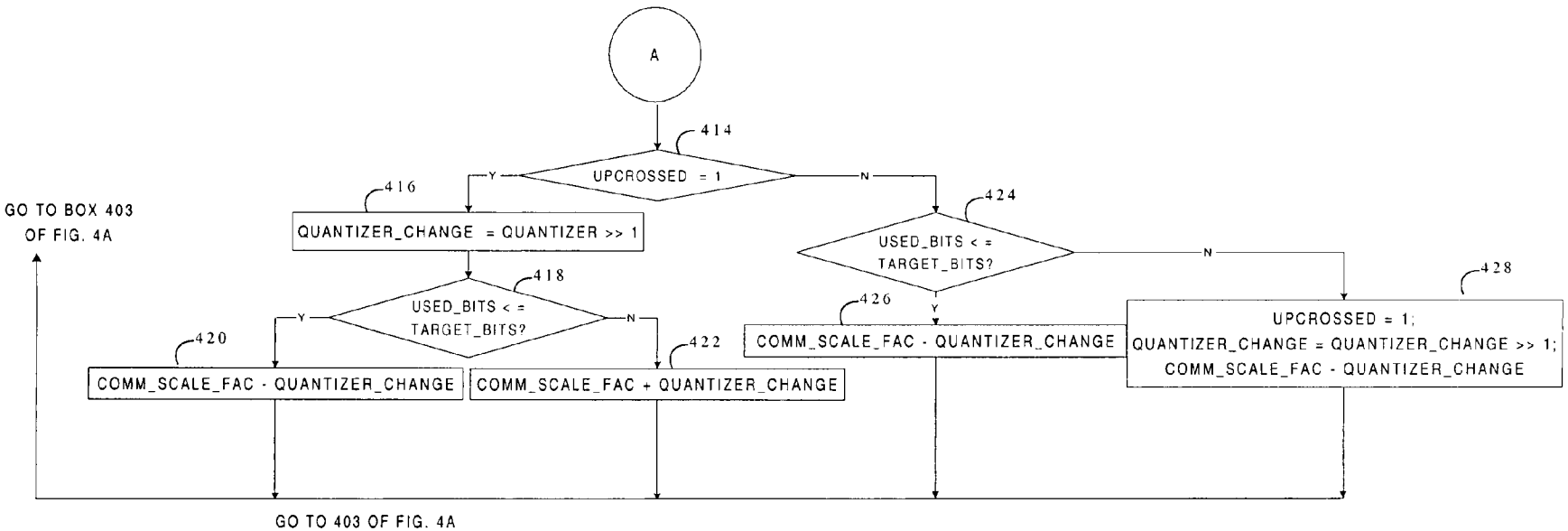
Figure 4C:
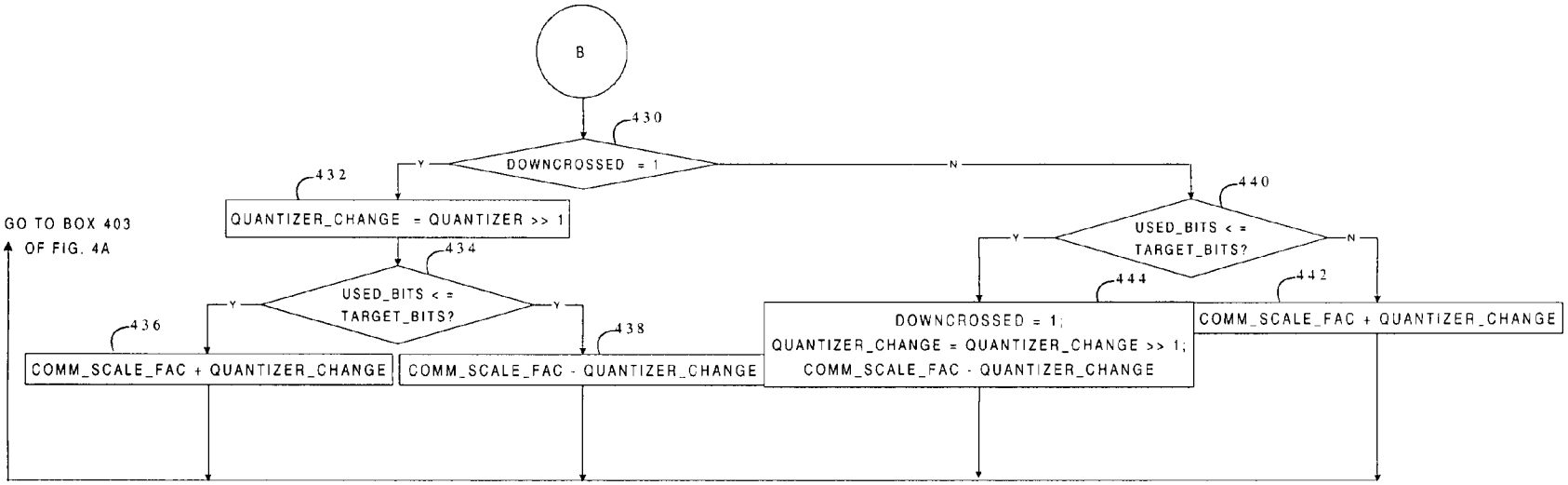

FIGS. 4A-4C are flow diagrams of one embodiment of a process 400 for using increase-bit/decrease-bit modification logic when modifying a common scale factor.

Referring to FIGS. 4A-4C, processing logic begins with setting a current value of a quanitzer change field to a predefined number (e.g., 4) and initializing a set of flags (processing block 402). The set of flags includes a rate change flag (referred to as "over_budget") that indicates a desired direction for changing the number of used bits (i.e., whether this number needs to be increased or decreased). In addition, the set of flags includes an upcrossed flag and a downcrossed flag. The upcrossed flag indicates whether the number of used bits that is desired to be incremented has crossed (i.e., is no longer less than or equal to) the target number of bits. The downcrossed flag indicates whether the number of used bits that is desired to be decreased has crossed (i.e., is no longer greater than) the target number of bits.

At decision box 403, processing logic determines whether the current value of the quantizer change field is equal to 0. If so, process 400 ends. If not, process 400 continues with processing logic quantizing the spectral data within the frame being processed using a current common scale factor and determining a number of bits used by the quantized spectral data upon Huffman encoding (processing block 404).

At decision box 406, processing logic determines whether the number of used bits is below the target number of bits. If yes, and this is not the first iteration (decision box 408), the rate change flag remains to be set to the value indicating the increase bit direction (e.g., over_budget=1). If not, or this is the first iteration (decision box 408), processing logic updates the rate change flag with the value indicating the decrease bit direction (e.g., over_budget=0) (processing block 410).

Further, if the rate change flag indicates the increase bit direction (decision box 412), processing logic determines whether the upcrossed flag is set to 1 (decision box 414). If so, processing logic calculates the current value of the quantizer change field as quantizer_change=quantizer_change>>1 (processing block 416) and determines whether the number of used bits is below the target number of bits (decision box 418). If so, processing logic subtracts the value of the quanitzer change field from the current common scale factor (processing block 420) and proceeds to decision box 404. If not, processing logic adds the value of the quanitzer change field to the current common scale factor (processing block 422) and proceeds to decision box 404.

If the upcrossed flag is set to 0 (decision box 414), processing logic determines whether the number of used bits is below the target number of bits (decision box 424). If so, processing logic subtracts the current value of the quanitzer change field from the current common scale factor (processing block 426) and proceeds to decision box 404. If not, processing logic sets the upcrossed flag to 1, calculates the new value of the quantizer change field as quantizer_change=quantizer_change>>1, subtracts the new value of the quanitzer change field from the current common scale factor (processing block 428), and proceeds to decision box 404.

If the rate change flag indicates the decrease bit direction (decision box 412), processing logic determines whether the downcrossed flag is set to 1 (decision box 430). If so, processing logic calculates the current value of the quantizer change field as quantizer_change=quantizer_change>>1 (processing block 432) and determines whether the number of used bits is below the target number of bits (decision box 434). If not, processing logic adds the current value of the quanitzer change field to the current common scale factor (processing block 436) and proceeds to decision box 404. If so, processing logic subtracts the current value of the quanitzer change field from the current common scale factor (processing block 438) and proceeds to decision box 404.

If the downcrossed flag is set to 0 (decision box 430), processing logic determines whether the number of used bits is below the target number of bits (decision box 440). If not, processing logic adds the current value of the quanitzer change field to the current common scale factor (processing block 442) and proceeds to decision box 404. If so, processing logic sets the downcrossed flag to 1, calculates the new value of the quantizer change field as quantizer_change=qiantizer_change>>1, subtracts the new value of the quanitzer change field from the current common scale factor (processing block 444), and proceeds to decision box 404.

Figure 5:
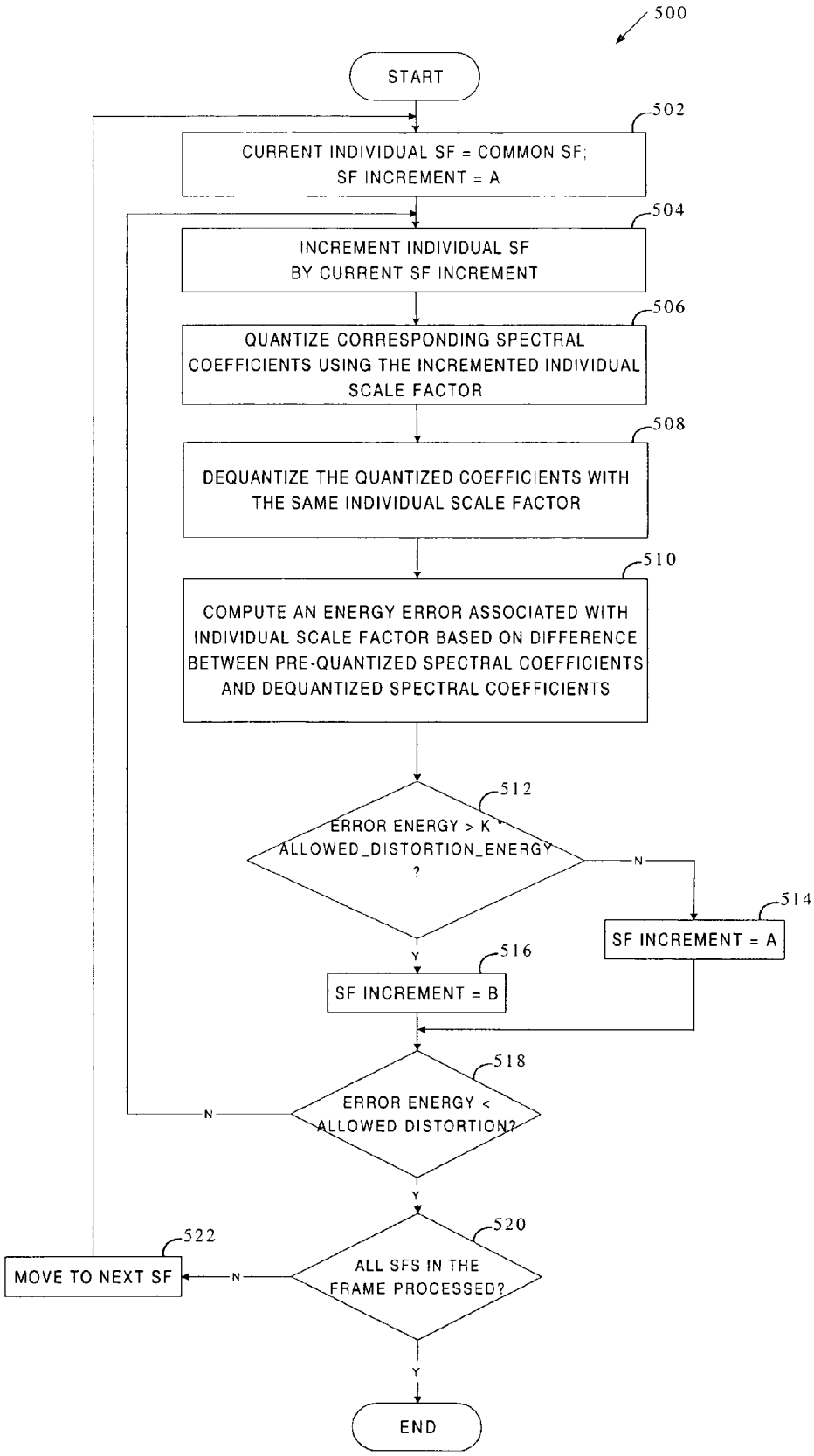
FIG. 5 is a flow diagram of one embodiment of a process for computing individual scale factors.

FIG. 5 is a flow diagram of one embodiment of a process 500 for computing individual scale factors.

Referring to FIG. 5, processing logic begins with a first individual scale factor by setting it to the value of the common scale factor and by setting a current increment field to a first constant A (e.g., A=1) (processing block 502). Then, processing logic increments this individual scale factor by the current increment value (processing block 504), quantizes corresponding spectral coefficients using the incremented individual scale factor (processing block 506), dequantizes the quantized coefficients with the same individual scale factor (processing block 508), and computes an energy error associated with this individual scale factor based on the difference between the original (pre-quantized) spectral coefficients and the dequantized spectral coefficients (processing block 510).

At decision box 512, processing logic determines whether the computed energy error is greater than K*allowed_distortion_energy, where K is a constant and allowed_distortion_energy is an allowed quantization error (also referred to as allowed distortion). In one embodiment, the allowed distortion is calculated based on the masking curve provided by the psychoacoustic modeler 106 of FIG. 1.

If the determination made at decision box 512 is negative, processing logic sets the current increment field to the first constant A (processing block 514). Otherwise, processing logic sets the current increment field to a second constant B (e.g., B=3) (processing block 516). In one embodiment, parameters A, B and K are determined experimentally, choosing the values that are likely to provide good performance.

Further, processing logic determines whether the computed energy error is lower than the allowed distortion (decision box 518). If not, processing logic returns to processing block 504 and repeats blocks 504 through 518. If so, the value of this individual scale factor is considered final, and processing logic moves to the next individual scalefactor (processing block 522). If all scale factors of this frame are processed (decision box 520), process 500 ends.

Figure 6:
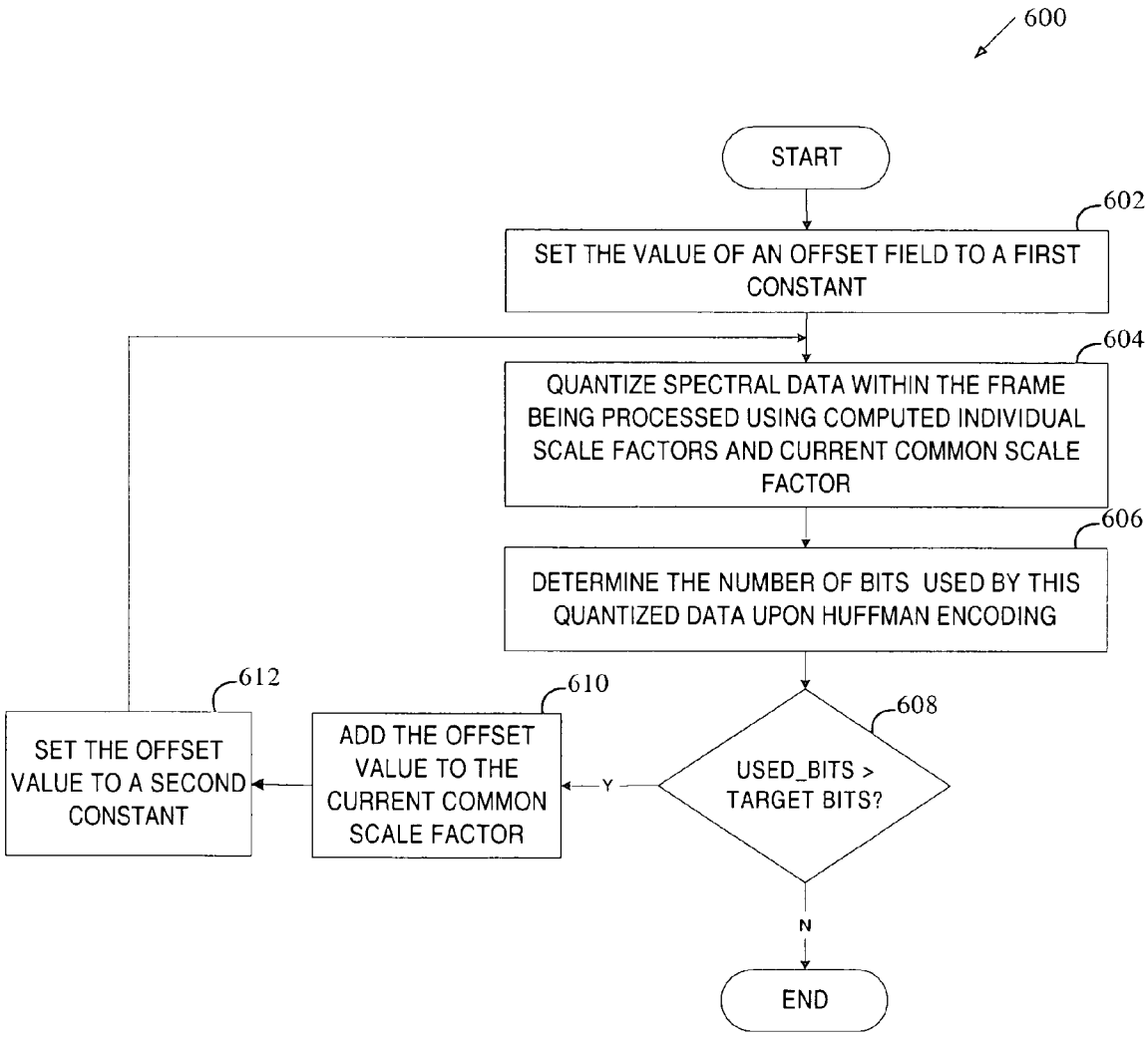
FIG. 6 is a flow diagram of one embodiment of a process for determining a final value of a common scale factor.

FIG. 6 is a flow diagram of one embodiment of a process 600 for determining a final value of a common scale factor.

Referring to FIG. 6, processing logic begins with setting the value of an offset field to a first constant (e.g., offset=3) (processing block 602). Next, processing logic quantizes spectral data within the frame being processed using computed individual scale factors and a current common scale factor (processing block 604) and determines the number of bits used by the quantized data upon Huffman encoding (processing block 606).

Further, processing logic determines whether the number of used bits exceeds the target number of bits (decision box 608). If so, processing logic adds the offset value to the current common scale factor (processing block 610), sets the offset value to a second constant (e.g., offset=1), and returns to processing block 604. Otherwise, if the number of used bits exceeds the target number of bits, process 600 ends.

Figure 7:
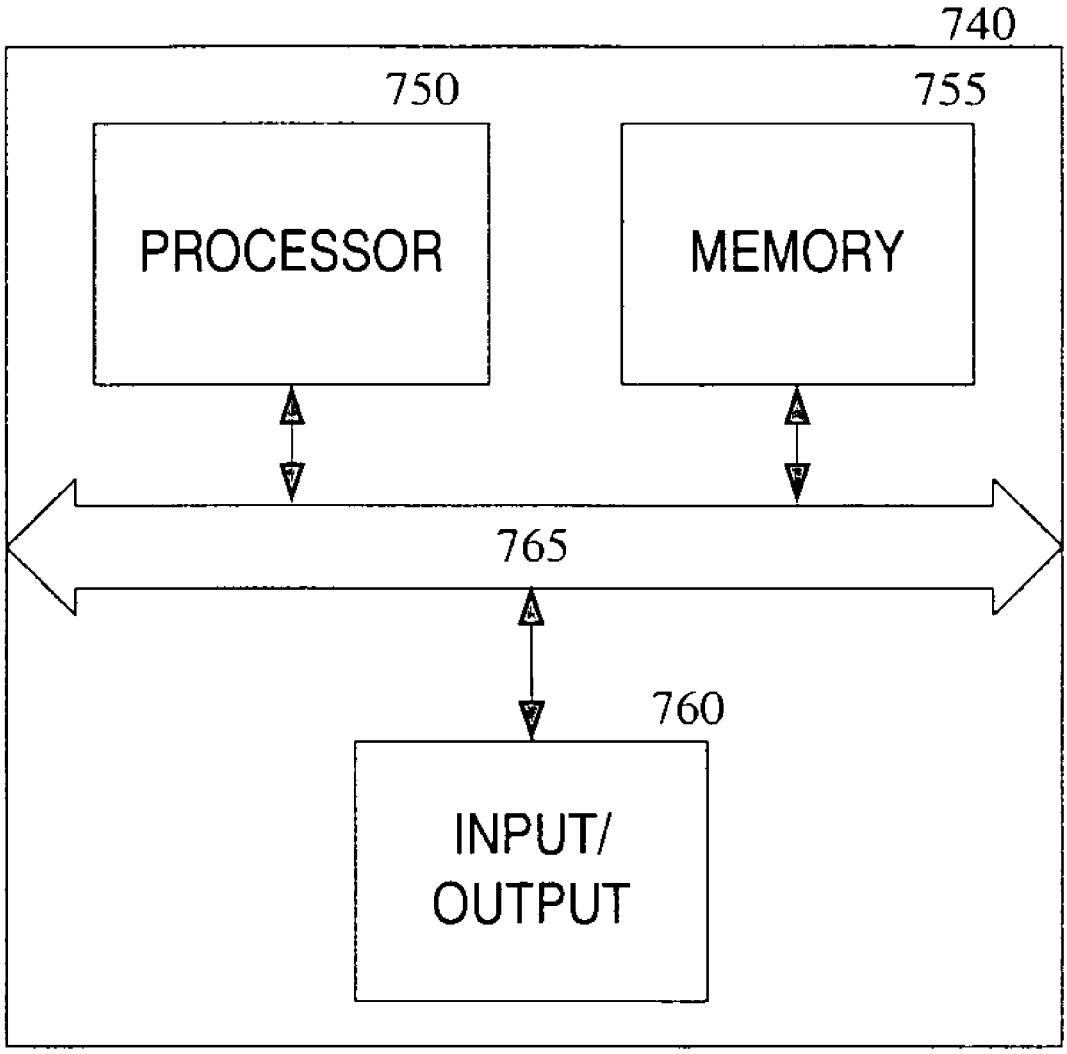
FIG. 7 is a block diagram of a computer environment suitable for practicing embodiments of the present invention.

The following description of FIG. 7 is intended to provide an overview of computer hardware and other operating components suitable for implementing the invention, but is not intended to limit the applicable environments. FIG. 7 illustrates one embodiment of a computer system suitable for use as an encoding system 100 or just a quantization module 110 of FIG. 1.

The computer system 740 includes a processor 750, memory 755 and input/output capability 760 coupled to a system bus 765. The memory 755 is configured to store instructions which, when executed by the processor 750, perform the methods described herein. Input/output 760 also encompasses various types of computer-readable media, including any type of storage device that is accessible by the processor 750. One of skill in the art will immediately recognize that the term "computer-readable medium/media" further encompasses a carrier wave that encodes a data signal. It will also be appreciated that the system 740 is controlled by operating system software executing in memory 755. Input/output and related media 760 store the computer-executable instructions for the operating system and methods of the present invention. The quantization module 110 shown in FIG. 1 may be a separate component coupled to the processor 750, or may be embodied in computer-executable instructions executed by the processor 750. In one embodiment, the computer system 740 may be part of, or coupled to, an ISP (Internet Service Provider) through input/output 760 to transmit or receive image data over the Internet. It is readily apparent that the present invention is not limited to Internet access and Internet web-based sites; directly coupled and private networks are also contemplated.

It will be appreciated that the computer system 740 is one example of many possible computer systems that have different architectures. A typical computer system will usually include at least a processor, memory, and a bus coupling the memory to the processor. One of skill in the art will immediately appreciate that the invention can be practiced with other computer system configurations, including multiprocessor systems, minicomputers, mainframe computers, and the like. The invention can also be practiced in distributed computing environments where tasks are performed by remote processing devices that are linked through a communications network.

Various aspects of selecting optimal scale factors have been described. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention.

What is claimed is:

1. A method comprising:

setting an initial common scale factor to a prior common scale factor if a maximum spectral coefficient within a frame of audio data is not equal to zero;

determining an initial number of bits associated with the initial common scale factor;

computing an initial increment using the initial number of bits and a target number of bits;

incrementing the initial common scale factor by the initial increment;

adjusting the incremented common scale factor based on the target number of bits;

computing a plurality of individual scale factors based on an allowed distortion for an encoded audio signal, the individual scale factors controlling distortion in the encoded audio signal, wherein an initial value for each individual scale factor is equal to the adjusted common scale factor;

if a current number of bits associated with the plurality of individual scale factors exceeds the target number of bits, modifying the adjusted common scale factor until a resulting number of bits no longer exceeds the target number of bits; and encoding the frame using the individual scale factors and the adjusted common scale factor.

2. The method of claim 1 wherein determining the initial common scale factor comprises:

if the maximum spectral coefficient is equal to zero, setting the initial common scale factor to 30.

3. The method of claim 1 wherein the prior common scale factor is any one of a common scale factor in a previous frame and a common scale factor in another channel.

4. The method of claim 1 wherein the initial increment is computed using an expression $$\text{initial_increment}=10*(\text{initial_bits}-\text{target_bits})/\text{target_bits},$$

wherein initial_increment is the initial increment, initial_bits is the initial number of bits, and target_bits is the target number of bits.

5. The method of claim 1 wherein adjusting the incremented common scale factor comprises:

quantizing spectral data within the frame using the incremented common scale factor;

determining that quantized spectral data is valid;

determining a current number of bits associated with the incremented common scale factor;

if the current number of bits exceeds the target number of bits, varying the incremented common scale factor in a decrease bit order; and if the current number of bits does not exceed the target number of bits, varying the incremented common scale factor in an increase bit order.

6. The method of claim 5 wherein the incremented common scale factor is varied until a current increment is equal to zero.

7. The method of claim 1 wherein computing a plurality of individual scale factors comprises:

iteratively adjusting each of the plurality of individual scale factors until an energy error associated with the adjusted each of the plurality of individual scale factors is below the allowed distortion.

8. The method of claim 7 wherein adjusting each of the plurality of individual scale factors comprises:

incrementing each of the plurality of individual scale factors by a current increment;

calculating an energy error associated with the incremented individual scale factor;

determining a type of the calculated energy error;

setting the current increment to a first constant if the calculated energy error is of a first type;

setting the current increment to a second constant if the calculated energy error is of a second type; and determining whether the calculated energy error is below the allowed distortion.

9. The method of claim 8 wherein determining a type of the calculated energy error comprises:

determining that the calculated energy error is of the first type if error_energy(sb)>K*allowed_distortion; and determining that the calculated energy error is of the second type if error_energy(sb)=<K*allowed_distortion, wherein error_energy(sb) is the calculated energy error associated with the incremented individual scale factor, K is a third constant, and allowed_distortion is the allowed distortion.

10. The method of claim 9 wherein values of the first constant, second constant and third constant are determined experimentally.

11. The method of claim 1 wherein modifying the adjusted common scale factor comprises:

determining that the current number of bits associated with the plurality of individual scale factors exceeds the target number of bits;

adding an offset value to the adjusted common scale factor to compute a modified common scale factor; and calculating the resulting number of bits associated with the plurality of individual scale factors and the modified common scale factor.

12. The method of claim 11 further comprising:

refraining from recomputing the plurality of individual scale factors when the adjusted common scale factor is modified.

13. A computer readable medium that provides instructions, which when executed on a processor cause the processor to perform a method comprising:

setting an initial common scale factor to a prior common scale factor if a maximum spectral coefficient within a frame of audio data is not equal to zero;

determining an initial number of bits associated with the initial common scale factor;

computing an initial increment using the initial number of bits and a target number of bits;

incrementing the initial common scale factor by the initial increment;

adjusting the incremented common scale factor based on the target number of bits;

computing a plurality of individual scale factors based on an allowed distortion for an encoded audio signal, the individual scale factors controlling distortion in the encoded audio signal, wherein an initial value for each individual scale factor is equal to the adjusted common scale factor;

if a current number of bits associated with the plurality of individual scale factors exceeds the target number of bits, modifying the adjusted common scale factor until a resulting number of bits no longer exceeds the target number of bits; and encoding the frame using the individual scale factors and the adjusted common scale factor.

14. The computer readable medium of claim 13 wherein determining the initial common scale factor comprises:

if the maximum spectral coefficient is equal to zero, setting the initial common scale factor to 30.

15. The computer readable medium of claim 13 wherein the prior common scale factor is any one of a common scale factor in a previous frame and a common scale factor in another channel.

16. A computerized system comprising:

a memory; and at least one processor coupled to the memory, the at least one processor executing a set of instructions from the memory which cause the at least one processor to set an initial common scale factor to a prior common scale factor if a maximum spectral coefficient within a frame of audio data is not equal to zero;

determine an initial number of bits associated with the initial common scale factor, compute an initial increment using the initial number of bits and a target number of bits, increment the initial common scale factor by the initial increment, adjust the incremented common scale factor based on the target number of bits, compute a plurality of individual scale factors based on an allowed distortion for an encoded audio signal, the individual scale factors controlling distortion in the encoded audio signal, wherein an initial value for each individual scale factor is equal to the adjusted common scale factor, if a current number of bits associated with the plurality of individual scale factors exceeds the target number of bits, modify the adjusted common scale factor until a resulting number of bits no longer exceeds the target number of bits, and encode the frame using the individual scale factors and the adjusted common scale factor.

17. The system of claim 16 wherein the at least one processor is to determine the initial common scale factor comprises by if the maximum spectral coefficient is equal to zero, setting the initial common scale factor to 30.

18. The system of claim 16 wherein the prior common scale factor is any one of a common scale factor in a previous frame and a common scale factor in another channel.

19. An encoding apparatus comprising:

a Huffman encoding module to determine an initial number of bits associated with an initial common scale factor and to encode a frame of audio data using individual scale factors and an adjusted common scale factor; and a quantization module to set an initial common scale factor to a prior common scale factor if a maximum spectral coefficient within the frame is not equal to zero, to compute an initial increment using the initial number of bits and a target number of bits, to increment the initial common scale factor by the initial increment, to adjust the incremented common scale factor based on the target number of bits, to compute a plurality of individual scale factors based on an allowed distortion for an encoded audio signal, the individual scale factors controlling distortion in the encoded audio signal, wherein an initial value for each individual scale factor is equal to the adjusted common scale factor, and if a current number of bits associated with the plurality of individual scale factors exceeds the target number of bits, to modify the adjusted common scale factor until a resulting number of bits no longer exceeds the target number of bits.

20. The apparatus of claim 19 wherein the quantization module is to determine the initial common scale factor by if the maximum spectral coefficient is equal to zero, setting the initial common scale factor to 30.

21. An apparatus comprising:

means for setting an initial common scale factor to a prior common scale factor if a maximum spectral coefficient is not equal to zero:

means for determining an initial number of bits associated with the initial common scale factor;

means for computing an initial increment using the initial number of bits and a target number of bits;

means for incrementing the initial common scale factor by the initial increment;

means for adjusting the incremented common scale factor based on the target number of bits;

means for computing a plurality of individual scale factors based on an allowed distortion for an encoded audio signal, the individual scale factors controlling distortion in the encoded audio signal, wherein an initial value for each individual scale factor is equal to the adjusted common scale factor;

means for modifying the adjusted common scale factor, if a current number of bits associated with the plurality of individual scale factors exceeds the target number of bits, until a resulting number of bits no longer exceeds the target number of bits; and means for encoding the frame using the individual scale factors and the adjusted common scale factor.

* * * * *